US010488783B2

(12) United States Patent
Kamei

(10) Patent No.: US 10,488,783 B2
(45) Date of Patent: Nov. 26, 2019

(54) IMAGE FORMING APPARATUS

(71) Applicant: CANON KABUSHIKI KAISHA, Tokyo (JP)

(72) Inventor: Yasuo Kamei, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/143,220

(22) Filed: Sep. 26, 2018

(65) Prior Publication Data

US 2019/0101843 A1 Apr. 4, 2019

(30) Foreign Application Priority Data

Sep. 29, 2017 (JP) ..... 2017-189561

(51) Int. Cl.
*G03G 15/00* (2006.01)
*G03G 15/043* (2006.01)

(52) U.S. Cl.
CPC ..... *G03G 15/043* (2013.01); *G03G 15/5004* (2013.01); *G03G 15/553* (2013.01); *G03G 15/80* (2013.01)

(58) Field of Classification Search
CPC ..... G03G 15/043
See application file for complete search history.

(56) References Cited

U.S. PATENT DOCUMENTS

2006/0033804 A1* 2/2006 Dan ..... G02B 26/121 347/230

FOREIGN PATENT DOCUMENTS

JP 2008-040295 A 2/2008

* cited by examiner

*Primary Examiner* — Clayton E. LaBalle
*Assistant Examiner* — Jas A Sanghera
(74) *Attorney, Agent, or Firm* — Canon USA, Inc., IP Division

(57) ABSTRACT

Optical scanning devices each have a Hall device for outputting a rotation signal by detecting a rotation of a motor. An optical scanning device controller has ASICs for performing startup control of the optical scanning devices, a CPU for controlling the ASICs, and a power supply path for supplying power to the optical scanning devices. The ASICs each have a FG counter for counting a clock signal and having a counter value to be reset by a rotation signal output from the Hall device. In a case where the motor is not normally driven when the optical scanning devices are started up, the CPU notifies an abnormality of the power supply device or the power supply path, based on a counter value of the FG counter acquired from each of the ASICs.

23 Claims, 11 Drawing Sheets

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| FG DATA (Y) | 999 | 899 | 799 | 699 | 599 | 499 | 399 | 299 | 199 | 99 | 50 | 130 | 100 | 100 | 100 |
| FG DATA (M) | 999 | 849 | 699 | 549 | 399 | 249 | 99 | 20 | 150 | 100 | 100 | 100 | 100 | 100 | 100 |
| FG DATA (C) | 999 | 919 | 839 | 759 | 679 | 599 | 519 | 439 | 359 | 279 | 199 | 119 | 39 | 105 | 100 |
| FG DATA (K) | 999 | 879 | 759 | 639 | 519 | 399 | 279 | 159 | 39 | 120 | 100 | 100 | 100 | 100 | 100 |

FIG.6

| SFGtotal | SFG(Y) | SFG(M) | SFG(C) | SFG(K) |
|---|---|---|---|---|
| 0 | 0 | 0 | 0 | 0 |
| 1 | 0 | 0 | 0 | 1 |
| | 0 | 0 | 1 | 0 |
| | 0 | 1 | 0 | 0 |
| | 1 | 0 | 0 | 0 |
| 2 | 0 | 0 | 1 | 1 |
| | 0 | 1 | 0 | 1 |
| | 1 | 0 | 0 | 1 |
| | 0 | 1 | 1 | 0 |
| | 1 | 0 | 1 | 0 |
| | 1 | 1 | 0 | 0 |
| 3 | 0 | 1 | 1 | 1 |
| | 1 | 0 | 1 | 1 |
| | 1 | 1 | 0 | 1 |
| | 1 | 1 | 1 | 0 |
| 4 | 1 | 1 | 1 | 1 |

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| FG DATA (Y) | 999 | 999 | 999 | 999 | 999 | 999 | 999 | 999 | 999 | 999 | 999 | 999 | 999 | 999 | 999 |
| FG DATA (M) | 999 | 999 | 999 | 999 | 999 | 999 | 999 | 999 | 999 | 999 | 999 | 999 | 999 | 999 | 999 |
| FG DATA (C) | 999 | 999 | 999 | 999 | 999 | 999 | 999 | 999 | 999 | 999 | 999 | 999 | 999 | 999 | 999 |
| FG DATA (K) | 999 | 999 | 999 | 999 | 999 | 999 | 999 | 999 | 999 | 999 | 999 | 999 | 999 | 999 | 999 |

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| FG DATA (Y) | 999 | 899 | 799 | 699 | 599 | 499 | 399 | 299 | 199 | 99 | 50 | 130 | 100 | 100 | 100 |
| FG DATA (M) | 999 | 849 | 699 | 549 | 399 | 249 | 99 | 20 | 150 | 100 | 100 | 100 | 100 | 100 | 100 |
| FG DATA (C) | 999 | 999 | 999 | 999 | 999 | 999 | 999 | 999 | 999 | 999 | 999 | 999 | 999 | 999 | 999 |
| FG DATA (K) | 999 | 999 | 999 | 999 | 999 | 999 | 999 | 999 | 999 | 999 | 999 | 999 | 999 | 999 | 999 |

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| FG DATA (Y) | 999 | 899 | 799 | 699 | 599 | 499 | 399 | 299 | 199 | 99 | 50 | 130 | 100 | 100 | 100 |
| FG DATA (M) | 999 | 849 | 699 | 549 | 399 | 249 | 99 | 20 | 150 | 100 | 100 | 100 | 100 | 100 | 100 |
| FG DATA (C) | 999 | 919 | 839 | 759 | 679 | 599 | 519 | 439 | 359 | 279 | 199 | 119 | 39 | 110 | 100 |
| FG DATA (K) | 999 | 999 | 999 | 999 | 999 | 999 | 999 | 999 | 999 | 999 | 999 | 999 | 999 | 999 | 999 |

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| FG DATA (Y) | 999 | 969 | 939 | 909 | 879 | 849 | 819 | 789 | 759 | 729 | 699 | 669 | 639 | 609 | 579 |
| FG DATA (M) | 999 | 849 | 699 | 549 | 399 | 249 | 99 | 20 | 150 | 100 | 100 | 100 | 100 | 100 | 100 |
| FG DATA (C) | 999 | 919 | 839 | 759 | 679 | 599 | 519 | 439 | 359 | 279 | 199 | 119 | 39 | 110 | 100 |
| FG DATA (K) | 999 | 879 | 759 | 639 | 519 | 399 | 279 | 159 | 39 | 120 | 100 | 100 | 100 | 100 | 100 |

IMAGE FORMING APPARATUS

BACKGROUND OF THE INVENTION

Field of the Invention

The present invention relates to an image forming apparatus including an optical scanning device.

Description of the Related Art

There has been known an image forming apparatus including an optical scanning device that forms an electrostatic latent image on a photosensitive member, by deflecting a light flux (a light beam) emitted from a light source such as a laser diode by a rotatable polygon mirror, and scanning a surface to be scanned of the photosensitive member. Image forming apparatuses of this type include a color image forming apparatus for forming a color image on a recording medium, and a monochrome image forming apparatus for forming a monochrome image on a recording medium. In general, the color image forming apparatus is configured to form an image by using toner of four colors of yellow, magenta, cyan, and black. As for color image forming apparatuses of recent years, a configuration having a photosensitive member and a development device for each color has been mainstream. Such color image forming apparatuses are further classified. Specifically, the color image forming apparatuses are classified into an image forming apparatus in which one optical scanning device corresponds to one photosensitive member, an image forming apparatus in which one optical scanning device corresponds to two photosensitive members, and an image forming apparatus in which one optical scanning device corresponds to four photosensitive members. As for the image forming apparatus in which one optical scanning device corresponds to one photosensitive member and the image forming apparatus in which one optical scanning device corresponds to two photosensitive members, a plurality of optical scanning devices are provided.

In an optical scanning device, a light beam output may attenuate or no light beam may be output due to an abnormality such as deterioration of a laser diode serving as a light source. This may cause a failure in an image to be formed on a recording medium. In such a situation, whether an abnormality has occurred in the optical scanning device may be determined by, for example, determining whether an output signal (hereinafter referred to as a beam detector (BD) signal) of a start position sensor (a beam detector) for deciding timing for starting irradiation of a light beam toward a photosensitive member is generated. The light beam emitted from the laser diode is incident on the start position sensor via a rotatable polygon mirror and various optical lenses included in the optical scanning device. Therefore, in a case where the BD signal is not output from the start position sensor, it is difficult to identify which one of the laser diode, the rotatable polygon mirror, and the start position sensor has an abnormality. For example, Japanese Patent Application Laid-Open No. 2008-040295 discusses an image forming apparatus for detecting a fault of an optical scanning device, by determining whether a value of a drive current of a laser diode is normal, and further by determining the presence or absence of output of a BD signal.

In the above-described conventional example, the fault is determined based on complex information by monitoring the drive current of the laser diode and the output of the BD signal. However, there is a case where the above-described image forming apparatus including the plurality of optical scanning devices has such a configuration that a control signal is common to the optical scanning devices, or power is supplied from the same power supply device. In a case where an abnormality occurs in the common control signal or the power supply device in such a configuration, a problem arises. Specifically, it is difficult to identify whether a fault is an abnormality of the optical scanning device or an abnormality of the common signal or the like, only by using the drive current of the laser diode and the presence or absence of the output of the BD signal.

Considering such a situation, the present invention is directed to accurately detecting a fault at the time of occurrence of an abnormality in an optical scanning device.

SUMMARY OF THE INVENTION

According to an aspect of the present invention, the present invention includes the following configuration.

An image forming apparatus includes a plurality of image forming units having a photosensitive member at which an image is to be formed, a plurality of optical scanning devices configured to expose the photosensitive member, a controller configured to control the plurality of optical scanning devices, and a power supply device configured to supply power to the optical scanning device, wherein the optical scanning device includes a motor and an output unit, the motor rotating a rotatable polygon mirror for deflecting a light beam to allow scanning of a surface of the photosensitive member by the light beam emitted from a light source for emitting the light beam, and the output unit outputting a rotation signal by detecting a rotation of the motor, wherein the controller includes a startup controller, a control unit, and a power supply path, the startup controller being provided for the optical scanning device and performing startup control of the optical scanning device based on output of a drive signal for driving the motor, the control unit controlling the startup controller, and the power supply path being provided to supply the optical scanning device with power generated by the power supply device, wherein the startup controller includes a counter for counting a clock signal, the counter having a counter value to be reset by the rotation signal output from the output unit, and wherein, in a case where the motor is not normally driven when the optical scanning device is started up, the control unit notifies an abnormality of the power supply device or the power supply path, based on a counter value of the counter acquired from the startup controller.

Further features of the present invention will become apparent from the following description of exemplary embodiments with reference to the attached drawings.

BRIEF DESCRIPTION OF THE DRAWINGS

FIG. 6 is a diagram illustrating SFGtotal according to an exemplary embodiment.

DESCRIPTION OF THE EMBODIMENTS

Exemplary embodiments of the present invention will be described in detail below with reference to the drawings.

[Configuration of Image Forming Apparatus]

Figure 1:
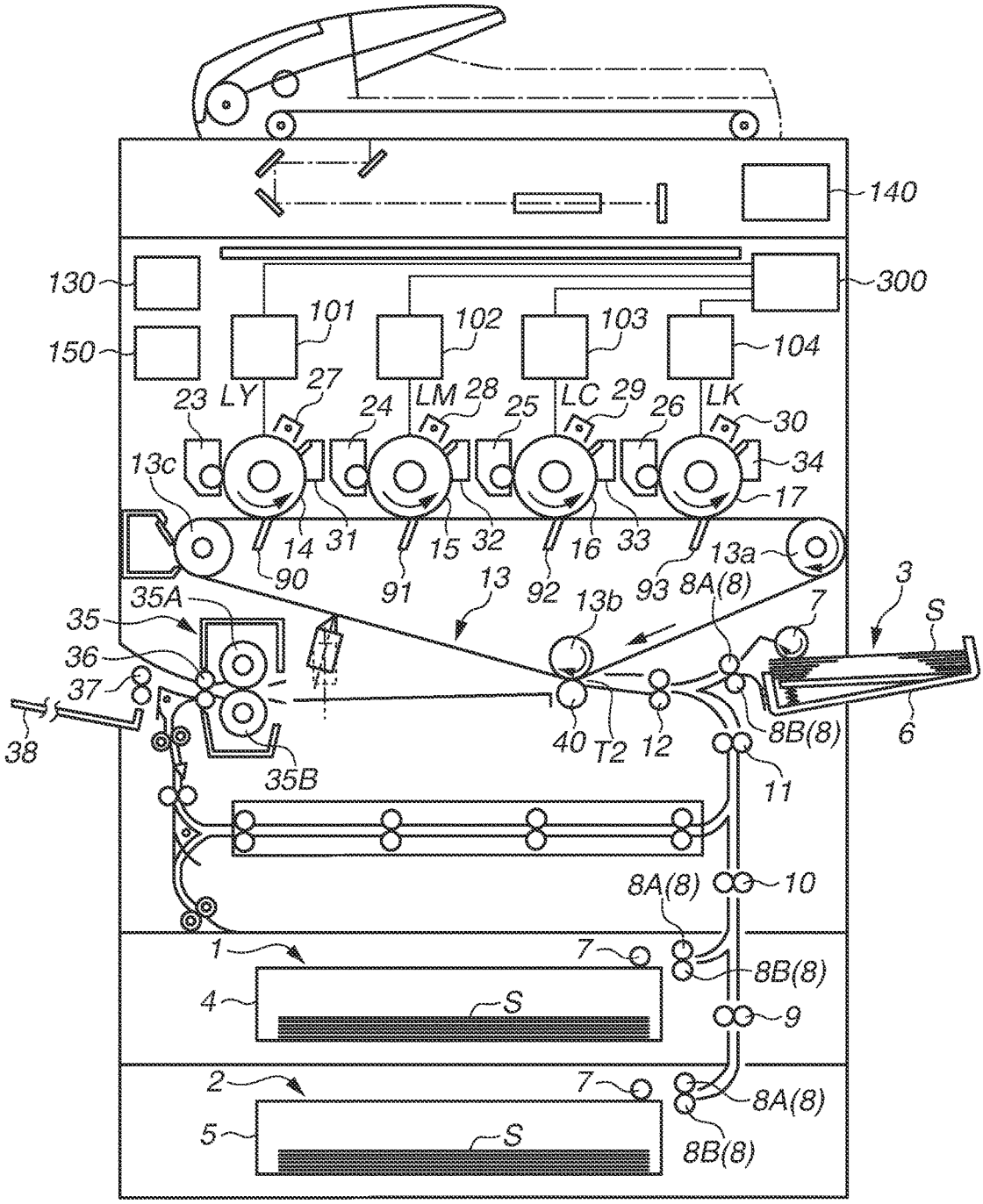
FIG. 1 is a cross-sectional diagram illustrating a configuration of a color image forming apparatus according to an exemplary embodiment.

FIG. 1 is a diagram illustrating a configuration of a color image forming apparatus for forming a color image according to an exemplary embodiment. Basic description of the color image forming apparatus according to the present exemplary embodiment and image formation will be provided with reference to FIG. 1. The color image forming apparatus includes two cassette feeders 1 and 2, and one manual feeder 3. A transfer sheet S serving as a recording medium is selectively fed from any of the cassette feeders 1 and 2 as well as the manual feeder 3 (hereinafter may be simply referred to as the feeders 1, 2, and 3, respectively). The transfer sheets S are stacked on a cassette 4 of the feeder 1, a cassette 5 of the feeder 2, or a tray 6 of the feeder 3. The stacked transfer sheets S are sequentially sent out toward a conveyance path by a pickup roller 7, starting from the uppermost transfer sheet S. Among the transfer sheets S sent out by the pickup roller 7, only the uppermost transfer sheet S is separated by a separation roller pair 8 formed of a feeding roller 8A serving as a conveyance unit and a retard roller 8B serving as a separation unit. The transfer sheet S is then sent to a registration roller pair 12 that is not rotating. In this case, the transfer sheet S fed from the cassette 4 or 5 having a long distance to the registration roller pair 12 is relayed by a plurality of conveyance roller pairs 9, 10, and 11 to be sent to the registration roller pair 12. The transfer sheet S sent to the registration roller pair 12 temporarily stops traveling, when a transfer-sheet leading edge abuts a nip portion of the registration roller pair 12 and thereby forms a predetermined loop. This formation of the loop corrects a skew state of the transfer sheet S.

An intermediate transfer belt 13 serving as an intermediate transfer member and having a long length is provided downstream from the registration roller pair 12 in the conveyance direction of the transfer sheet S (hereinafter may be simply referred to as the downstream side). The intermediate transfer belt 13 is stretched by a drive roller 13*a*, a secondary-transfer counter roller 13*b*, and a tension roller 13*c*, and set to have a substantially triangular shape in a cross-sectional view. The intermediate transfer belt 13 rotates in a clockwise direction in FIG. 1. Photosensitive drums 14, 15, 16, and 17 are provided on the top surface of a horizontal portion of the intermediate transfer belt 13, and sequentially disposed along the rotation direction of the intermediate transfer belt 13. The photosensitive drums 14, 15, 16, and 17 serve as a plurality of photosensitive members for forming and bearing toner images of different colors. The photosensitive drum 14 disposed most upstream in the rotation direction of the intermediate transfer belt 13 bears a toner image of yellow (Y). The photosensitive drum 15 disposed next bears a toner image of magenta (M). The photosensitive drum 16 disposed next bears a toner image of cyan (C). The photosensitive drum 17 disposed most downstream in the rotation direction of the intermediate transfer belt 13 bears a toner image of black (K).

Optical scanning devices 101, 102, 103, and 104 each serving as an exposure device are provided above the photosensitive drums 14, 15, 16, and 17, respectively, in FIG. 1. The optical scanning devices 101 to 104 can simultaneously perform exposure of yellow, magenta, cyan, and black, respectively, and each contains a light source, a rotatable polygon mirror, a scanner motor, and an optical lens. The image forming apparatus according to the present exemplary embodiment includes one optical scanning device for each of the photosensitive drums 14 to 17 of the respective colors. The included optical scanning device is the above-described optical scanning device having a 1-in-1 configuration. The photosensitive drums 14 to 17 are provided at the respective positions facing the optical scanning devices 101 to 104, so as to form electrostatic latent images on the photosensitive drums 14 to 17 by emitting laser beams LY, LM, LC, and LK, respectively. The optical scanning devices 101 to 104 will be described in detail below.

The image formation in the image forming apparatus illustrated in FIG. 1 is performed as follows. First, exposure of the laser beam (is also a light beam) LY based on an image of a yellow component is started on the photosensitive drum 14 (on the photosensitive member) disposed most upstream of the intermediate transfer belt 13, and an electrostatic latent image is thereby formed on the photosensitive drum 14. The electrostatic latent image formed on the photosensitive drum 14 is visualized by the toner of yellow supplied from a development device 23. Next, after the elapse of a predetermined time following the start of the exposure of the laser beam LY on the photosensitive drum 14, exposure of a laser beam LM based on an image of a magenta component is started on the photosensitive drum 15, and an electrostatic latent image is thereby formed on the photosensitive drum 15. The electrostatic latent image formed on the photosensitive drum 15 is visualized by the toner of magenta supplied from the development device 24. Subsequently, after the elapse of a predetermined time following the start of the exposure of the laser beam LM on the photosensitive drum 15, exposure of a laser beam LC based on an image of a cyan component is started on the photosensitive drum 16, and an electrostatic latent image is thereby formed on the photosensitive drum 16. The electrostatic latent image formed on the photosensitive drum 16 is visualized by the toner of cyan supplied from a development device 25. Finally, after the elapse of a predetermined time following the start of the exposure of the laser beam LC on the photosensitive drum 16, exposure of a laser beam LK based on an image of a black component is started on the photosensitive drum 17, and an electrostatic latent image is thereby formed on the photosensitive drum 17. The electrostatic latent image formed on the photosensitive drum 17 is visualized by the toner of black supplied from a development device 26. Primary chargers 27, 28, 29, and 30 for uniformly charging the photosensitive drums 14, 15, 16, and 17, respectively, are installed around the photosensitive drums 14, 15, 16, and 17, respectively. Also installed are components such as cleaners 31, 32, 33, and 34 for removing the toner adhering to the photosensitive drums 14, 15, 16, and 17, respectively, after the respective toner images are transferred.

While the intermediate transfer belt 13 rotates in the clockwise direction, the intermediate transfer belt 13 passes through a transfer portion between the photosensitive drum 14 and a transfer charger 90, and the toner image of yellow is thereby transferred onto the intermediate transfer belt 13. Next, the intermediate transfer belt 13 passes through a transfer portion between the photosensitive drum 15 and a transfer charger 91, and the toner image of magenta is thereby transferred onto the intermediate transfer belt 13. Subsequently, the intermediate transfer belt 13 passes through a transfer portion between the photosensitive drum 16 and a transfer charger 92, and the toner image of cyan is thereby transferred onto the intermediate transfer belt 13. Finally, the intermediate transfer belt 13 passes through a transfer portion between the photosensitive drum 17 and a transfer charger 93, and the toner image of black is thereby transferred onto the intermediate transfer belt 13. The transfer of the toner image of the color from each of the photosensitive drums 14 to 17 onto the intermediate transfer belt 13 is performed with a timing, and the toner images of yellow, magenta, cyan, and black are transferred onto the intermediate transfer belt 13 to be superimposed on one another.

Meanwhile, the transfer sheet S is sent to the registration roller pair 12 so that the skew state is corrected. The registration roller pair 12 start rotating, with a timing for allowing the position of the leading edge of the transfer sheet S to coincide with the toner images on the intermediate transfer belt 13. Next, the transfer sheet S is sent by the registration roller pair 12 to a transfer portion T2, which is an abutting portion between a secondary transfer roller 40 and the secondary-transfer counter roller 13*b* on the intermediate transfer belt 13. The color toner image is thereby transferred onto the transfer sheet S. Upon passing through the transfer portion T2, the transfer sheet S is sent to a fixing device 35 serving as a fixing unit. Subsequently, while the transfer sheet S passes through a nip portion formed of a fixing roller 35A and a pressing roller 35B in the fixing device 35, the toner image is heated by the fixing roller 35A and pressed by the pressing roller 35B, and the toner image is thereby fixed to the transfer sheet S. Upon passing through the fixing device 35, the transfer sheet S is sent to a discharging roller pair 37 by a conveyance roller pair 36, and further, discharged onto a discharge tray 38 provided outside the apparatus. The color image forming apparatus in FIG. 1 is an example, and may be, for example, a monochrome image forming apparatus, without being limited to the configuration according to the present exemplary embodiment.

A controller 130 controls each of the above-described devices to perform the above-described image forming operation. A power supply device 150 generates a 5-V direct current (DC) to be supplied to a control system including the controller 130 and an optical scanning device controller 300 to be described below. The power supply device 150 also generates a 24-V DC to be supplied to a load of a driving system such as a motor. Further, an operation unit 140 is provided in an upper part of the image forming apparatus. The operation unit 140 has an input portion for inputting data and a display portion for displaying information. The optical scanning device controller 300 (hereinafter referred to as the controller 300) serving as a controller controls the optical scanning devices 101 to 104 (to be described in detail below).

[Internal Configuration of Optical Scanning Device]

Figure 2:
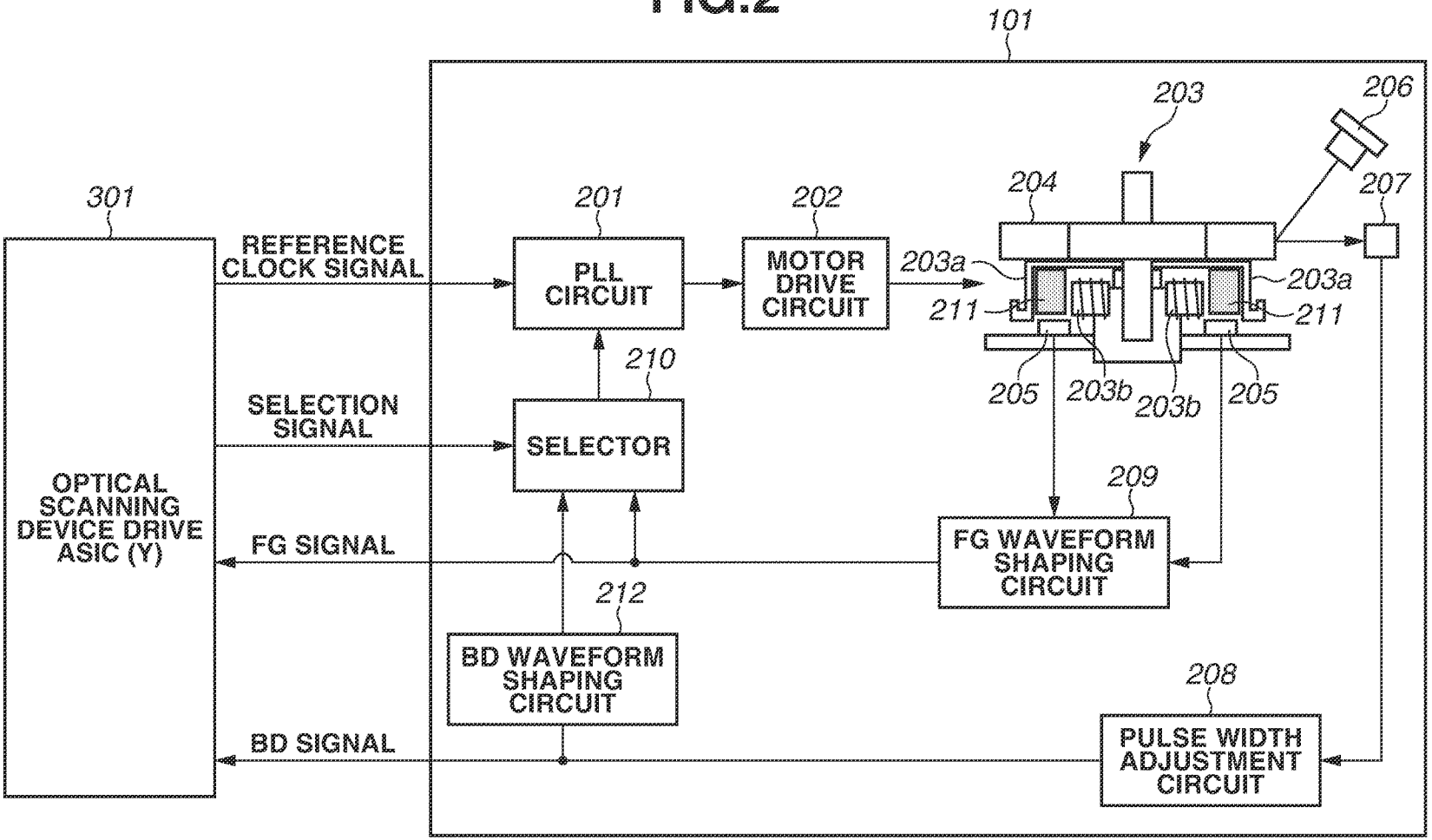
FIG. 2 is a block diagram illustrating a configuration of an optical scanning device according to an exemplary embodiment.

FIG. 2 illustrates an internal configuration of the optical scanning device 101 for forming the electrostatic latent image of the yellow component on the photosensitive drum 14. FIG. 2 also illustrates an optical scanning device drive application-specific integrated circuit (ASIC) 301 for controlling the driving of a scanner motor 203 of the optical scanning device 101. A similar internal configuration is provided in each of the optical scanning devices 102 to 104 for forming the electrostatic latent images on the photosensitive drums 15 to 17. Furthermore, a similar configuration is provided in each of optical scanning device drive ASICs 302 to 304 to be described below for controlling the optical scanning devices 102 to 104. The description will be provided below using the optical scanning device 101 and the optical scanning device drive ASIC 301 (hereinafter referred to as the ASIC 301) as an example.

The optical scanning device 101 has a phase-locked loop (PLL) circuit 201, a motor drive circuit 202, the scanner motor 203, a laser diode 206, a beam detector 207, a pulse width adjustment circuit 208, a frequency generator (FG) waveform shaping circuit 209, a selector 210, and a beam detector (BD) waveform shaping circuit 212. The PLL circuit 201, the motor drive circuit 202, the pulse width adjustment circuit 208, the FG waveform shaping circuit 209, the selector 210, and the BD waveform shaping circuit 212 may be formed in a single integrated circuit. Further, at least one of the PLL circuit 201, the motor drive circuit 202, the pulse width adjustment circuit 208, the FG waveform shaping circuit 209, the selector 210, and the BD waveform shaping circuit 212 may be built in a different integrated circuit, or all of these circuits may be built in different integrated circuits. A plurality of magnets 211 is attached to an inner circumferential surface of a rotor 203*a* of the scanner motor 203. A rotatable polygon mirror 204 for deflecting a laser beam emitted from the laser diode 206 serving as a light source is fixed to the rotor 203*a*. Furthermore, the scanner motor 203 has a Hall device 205 serving as an output unit for detecting a rotating state of the scanner motor 203. In the scanner motor 203, the rotor 203*a* rotates by feeding of an electric current to a coil 203*b*, and following the rotation, the rotatable polygon mirror 204 rotates. When the scanner motor 203 rotates, i.e., when the rotor 203*a* rotates, a magnetic flux around the Hall device 205 changes. Following the rotation of the rotor 203*a* (according to a rotation speed), the Hall device 205 converts the flux change around the Hall device 205 into an FG signal that is an electric signal, and outputs the FG signal.

The FG waveform shaping circuit 209 shapes the waveform of the FG signal output from the Hall device 205. The FG waveform shaping circuit 209 shapes the waveform to output the input FG signal of one pulse each time the scanner motor 203 makes one rotation, and then outputs the FG signal to the selector 210 and the ASIC 301. The beam detector 207 (hereinafter referred to as the BD 207) outputs a BD signal upon receiving a laser beam, which is deflected by the rotatable polygon mirror 204 after being emitted from the laser diode 206. The rotatable polygon mirror 204 has a plurality of reflection surfaces, and the BD signal is output according to the number of the reflection surfaces each time the scanner motor 203 makes one rotation. The pulse width adjustment circuit 208 adjusts the pulse width of the BD signal output from the BD 207 to have, for example, a duty ratio of 50%, and outputs the BD signal with the adjusted pulse width to the ASIC 301 and the BD waveform shaping circuit 212. The BD waveform shaping circuit 212 shapes the waveforms of the plurality of BD signals that are output each time the scanner motor 203 makes one rotation, such that a 1-pulse signal is to be output each time the scanner motor 203 makes one rotation. The BD waveform shaping circuit 212 then outputs the pulse signal to the selector 210.

The selector 210 outputs the FG signal input from the FG waveform shaping circuit 209 or the pulse signal input from the BD waveform shaping circuit 212, to the PLL circuit 201, according to a selection signal output from the ASIC 301. The PLL circuit 201 outputs a clock signal formed by synchronizing a reference clock signal input from the ASIC 301 with the phase of the signal output from the selector 210. The motor drive circuit 202 generates a drive signal based on the clock signal input from the PLL circuit 201 and thereby drives the scanner motor 203. This allows the scanner motor 203 to rotate the rotatable polygon mirror 204, and the surface of the photosensitive drum 14 is thereby scanned by the laser beam emitted from the laser diode 206. An electrostatic latent image can be thus formed.

The ASIC 301 receives the FG signal and the BD signal serving as a rotation signal from the optical scanning device 101, and outputs a reference clock signal and a selection signal to the optical scanning device 101. The selection signal specifies a signal to be output from the selector 210 to the PLL circuit 201. Further, the ASIC 301 has a counter to be incremented by an internal clock.

[Configuration of Optical Scanning Device Controller]

Figure 3:
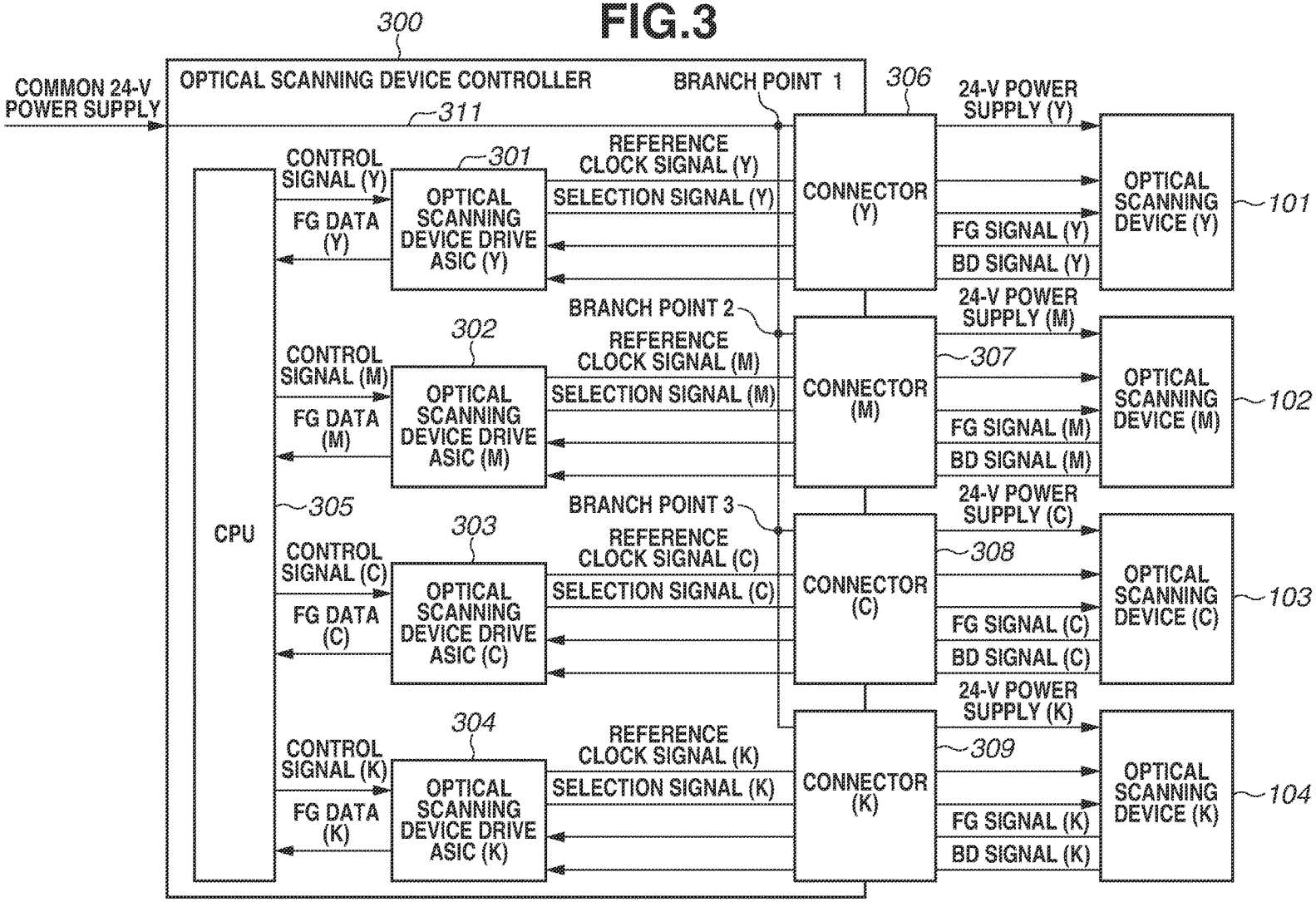
FIG. 3 is a block diagram illustrating a configuration of an optical scanning device controller according to an exemplary embodiment.

FIG. 3 is a diagram illustrating relations of various signal lines connecting an internal configuration of the controller 300 for controlling the optical scanning devices 101 to 104, and the optical scanning devices 101 to 104. The controller 300 includes the optical scanning device drive ASICs 301 to 304 (hereinafter referred to as the ASICs 301 to 304) for controlling the optical scanning devices 101 to 104, respectively. The optical scanning devices 101 to 104 are provided to expose the photosensitive drums 14 to 17 of yellow (Y), magenta (M), cyan (C), and black (K), respectively. The controller 300 further includes a central processing unit (CPU) 305 serving as a control unit for controlling the optical scanning devices 101 to 104, via the ASICs 301 to 304 serving as a startup controller. The controller 300 and the optical scanning devices 101 to 104 are connected via connectors 306 to 309 serving as a connection unit. Signal transmission and reception between the ASICs 301 to 304 and the optical scanning devices 101 to 104 as well as power supply to the optical scanning devices 101 to 104 are performed via the connectors 306 to 309.

The 24-V DC generated in the power supply device 150 is supplied to each of the optical scanning devices 101 to 104 to drive the scanner motor 203. Specifically, a 24-V DC power supply voltage (indicated as common 24-V power supply in FIG. 3) is input to the controller 300, and then supplied to each of the optical scanning devices 101 to 104 via a power supply path 311. In other words, from the power supply path 311 which is a power source pattern provided on a control circuit board of the controller 300, the power is supplied to the optical scanning device 101 via a branch path from a branch point 1 to the connector 306, and also supplied to the optical scanning device 102 via a branch path from a branch point 2 to the connector 307. Further, the power is supplied to the optical scanning device 103 via a branch path from a branch point 3 to the connector 308, and the power is directly supplied from the power supply path 311 to the optical scanning device 104. In this way, the 24-V DC is supplied from the common power supply path 311 to each of the optical scanning devices 101 to 104, in the controller 300. Hence, for example, in a case where the power supply path 311 of the 24-V DC is disconnected before the branch point 1, the power supply to all the optical scanning devices 101 to 104 are interrupted. In a case where the power supply path 311 is disconnected between the branch point 1 and the branch point 2, the power supply to the optical scanning devices 102 to 104 is interrupted. In a case where the power supply path 311 is disconnected between the branch point 2 and the branch point 3, the power supply to the optical scanning devices 103 and 104 is interrupted. In a case where the power supply path 311 is disconnected between the branch point 3 of the power supply path 311 and the connector 309, the power supply to the optical scanning device 104 is interrupted. In the power supply path 311, the power supply is performed in order of the optical scanning devices 101, 102, 103, and 104 from the upstream side to the downstream side, but the order is an example, and the order of the power supply is not limited to the example.

From the CPU 305, control signals (Y) to (K) for ordering startup or startup-stop of the optical scanning devices 101 to 104 are output to the ASICs 301 to 304, respectively. From the ASICs 301 to 304, FG data (Y) to (K) to be described below are output to the CPU 305. In FIG. 3, (Y), (M), (C), and (K) of the optical scanning devices 101 to 104 and the ASICs 301 to 304 indicate configurations corresponding to yellow (Y), magenta (M), cyan (C), and black (K), respectively. This also holds true for similar subscripts (Y), (M), (C), and (K) affixed to the ends of the respective signal lines (e.g., the reference clock signal, the 24-V power supply, the FG signal, and the BD signal). In the following description, the subscripts will be omitted except in a case where a specific configuration or a specific signal is specified.

Next, operation performed by the CPU 305 to control the optical scanning devices 101 to 104 via the ASICs 301 to 304 will be described. In a case where image formation is performed, the controller 130 instructs the controller 300 to start up the optical scanning devices 101 to 104, prior to the image formation. The CPU 305 of the controller 300 transmits control signals for ordering startup of the optical scanning devices 101 to 104 to the ASICs 301 to 304, according to a startup instruction from the controller 130. Upon receiving the control signals from the CPU 305, the ASICs 301 to 304 output the reference clock signal and the selection signal for ordering selection of the FG signal, to the optical scanning devices 101 to 104. In order to stop the driving of the scanner motors 203 by stopping the startup of the optical scanning devices 101 to 104, the CPU 305 transmits control signals for ordering startup-stop of the optical scanning devices 101 to 104 (driving stop of the scanner motor 203), to the ASICs 301 to 304. In the present exemplary embodiment, the startup-start and the startup-stop of the optical scanning devices 101 to 104 are controlled by output and output-stop of the reference clock signals.

In the optical scanning devices 101 to 104, startup of the scanner motors 203 is performed according to the control of the ASICs 301 to 304. The PLL circuit 201 generates a drive signal based on the FG signal output from the selector 210 and the reference clock signal input from the corresponding one of the ASICs 301 to 304. The generated drive signal is output to the motor drive circuit 202, and the motor drive circuit 202 performs rotation control for the scanner motor 203 according to the drive signal. The ASICs 301 to 304 each output, to the CPU 305, the FG data, which is measured in a predetermined sampling period (in the present exemplary embodiment, a period corresponding to one rotation of the scanner motor 203 is the sampling period) according to the FG signal output from the corresponding one of the optical scanning devices 101 to 104. The method for measuring the FG data according to the FG signal will be described below. Subsequently, based on the FG data output from the ASICs 301 to 304, the CPU 305 determines the presence or absence of an abnormal state of each of the optical scanning devices 101 to 104. When detecting the abnormal state, the CPU 305 notifies the controller 130 of the resultant.

Further, the ASICs 301 to 304 determine rotating states of the respective scanner motors 203, based on the FG signals output from the optical scanning devices 101 to 104. If the ASICs 301 to 304 each determine that the scanner motor 203 has reached a stable rotation state, the ASICs 301 to 304 each output a selection signal for ordering selection of the BD signal to the selector 210. The PLL circuits 201 of the optical scanning devices 101 to 104 thereby generate drive signals based on the BD signals output from the selectors 210 according to the selection signals and the reference clock signals input from the ASICs 301 to 304. The generated drive signal is output to the motor drive circuit 202, and the motor drive circuit 202 performs rotation control for the scanner motor 203 according to the drive signal. The CPU 305 determines a rotating state of each of the scanner motors 203, based on the BD signals output from the optical scanning devices 101 to 104 via the ASICs 301 to 304. When the CPU 305 determines that the scanner motors 203 of all the optical scanning devices 101 to 104 are stably rotating, the CPU 305 notifies the controller 130 of startup completion of the optical scanning devices 101 to 104, and the controller 130 starts the image formation.

[Measurement of FG Data]

Figure 4A:
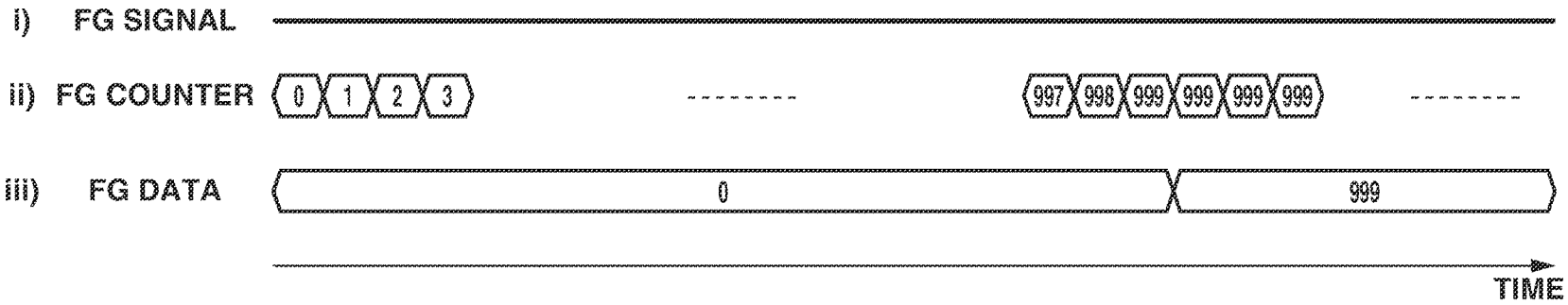
FIGS. 4A and 4B are diagrams illustrating a method for calculating frequency generator (FG) data according to an exemplary embodiment.
Figure 4B:
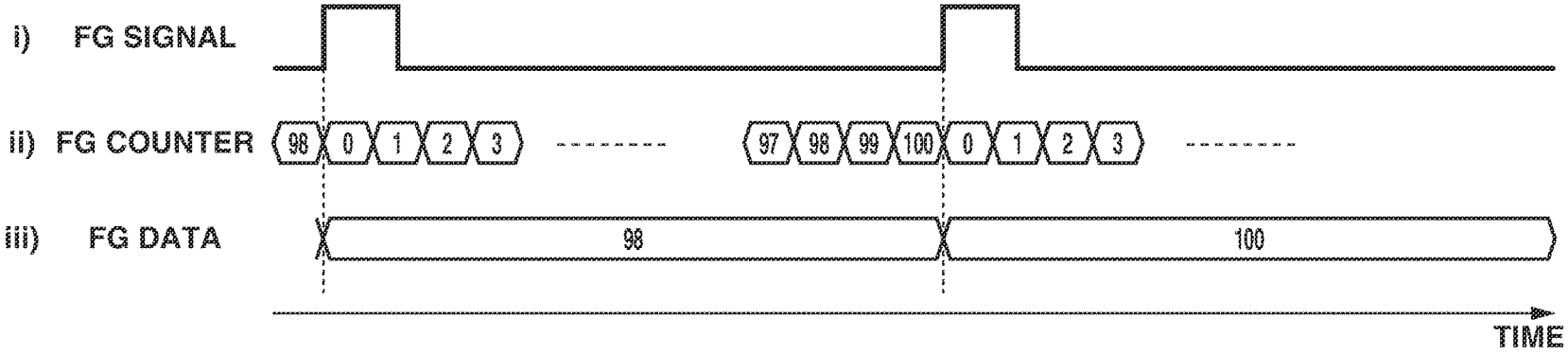

Next, the method for measuring the FG data output from the ASICs 301 to 304 to the CPU 305 will be described. FIGS. 4A and 4B each illustrate an FG signal (indicated with "i)") output from each of the optical scanning devices 101 to 104 to the corresponding one of the ASICs 301 to 304, a counter value (indicated with "ii)") of the FG counter serving as an internal counter of each of the ASICs 301 to 304, and FG data (indicated with "iii)"). FIG. 4A illustrates the FG signal, the counter value of the FG counter, and the FG data immediately after the startup of the scanner motor 203. FIG. 4B illustrates the FG signal, the counter value of the FG counter, and the FG data when the scanner motor 203 stably rotates. In each of FIGS. 4A and 4B, a horizontal axis indicates the time.

First, counting operation of the FG counter will be described. The FG counter is provided inside each of the ASICs 301 to 304, and is incremented in response to input of a clock signal. In the present exemplary embodiment, the counter value becomes 0 when the FG counter is reset, and counting stops when the counter value becomes 999 that is a predetermined value. In response to input of a control signal from the CPU 305, the FG counter is reset and starts counting. Further, the FG counter is controlled to be reset in synchronization with a rising edge of the FG signal output from each of the optical scanning devices 101 to 104 and to start counting again. When the counter value becomes 999, the FG counter keeps holding the counter value (999) until the FG signal is input and the FG counter is reset at the rising edge of the FG signal, or the control signal is input from the CPU 305 to reset the FG counter. When the rising edge of the FG signal is input, the ASICs 301 to 304 each latch the counter value of the FG counter at that time. Alternatively, when the counter value of the FG counter becomes 999, the ASICs 301 to 304 each latch the counter value of 999 at that time. The ASICs 301 to 304 then each output the latched counter value of the FG counter to the CPU 305 as the FG data.

FIG. 4A illustrates the state of the FG signal, the FG counter, and the FG data immediately after the startup of the scanner motor 203. Therefore, FIG. 4A illustrates such a state that the FG signal is not input from each of the optical scanning devices 101 to 104 to the corresponding one of the ASICs 301 to 304 (see "i)" in FIG. 4A) and, as a result, the FG counter is latched at 999, and the FG data is 999 (see "ii)" and "iii)" in FIG. 4A). A state similar to such a state occurs, for example, also in an abnormal state where the scanner motor 203 maintains the stop state even though the control signal is output from the CPU 305 to each of the ASICs 301 to 304 to start up the scanner motor 203. In this case as well, the FG counter is latched at the counter value of 999, and 999 is output as the FG data.

FIG. 4B illustrates the state of the FG signal, the FG counter, and the FG data when the scanner motor 203 stably rotates. When the scanner motor 203 stably rotates, the FG waveform shaping circuit 209 shapes the FG signal output from the Hall device 205 into an FG signal having a predetermined pulse width, and outputs the FG signal obtained by the shaping to the corresponding one of the ASICs 301 to 304 each time the scanner motor 203 makes one rotation. In FIG. 4B, "i)" and "ii)" indicate such a state that, in each of the ASICs 301 to 304, the FG counter is reset in synchronization with the rising edge of the FG signal input from the corresponding one of the optical scanning devices 101 to 104 and starts again. At this moment, as for the FG data output to the CPU 305, the counter value (98 and 100 in "iii)" in FIG. 4B) of the FG counter at that time is output in synchronization with the rising edge of the FG signal.

[Example of FG Data]

Figure 5:
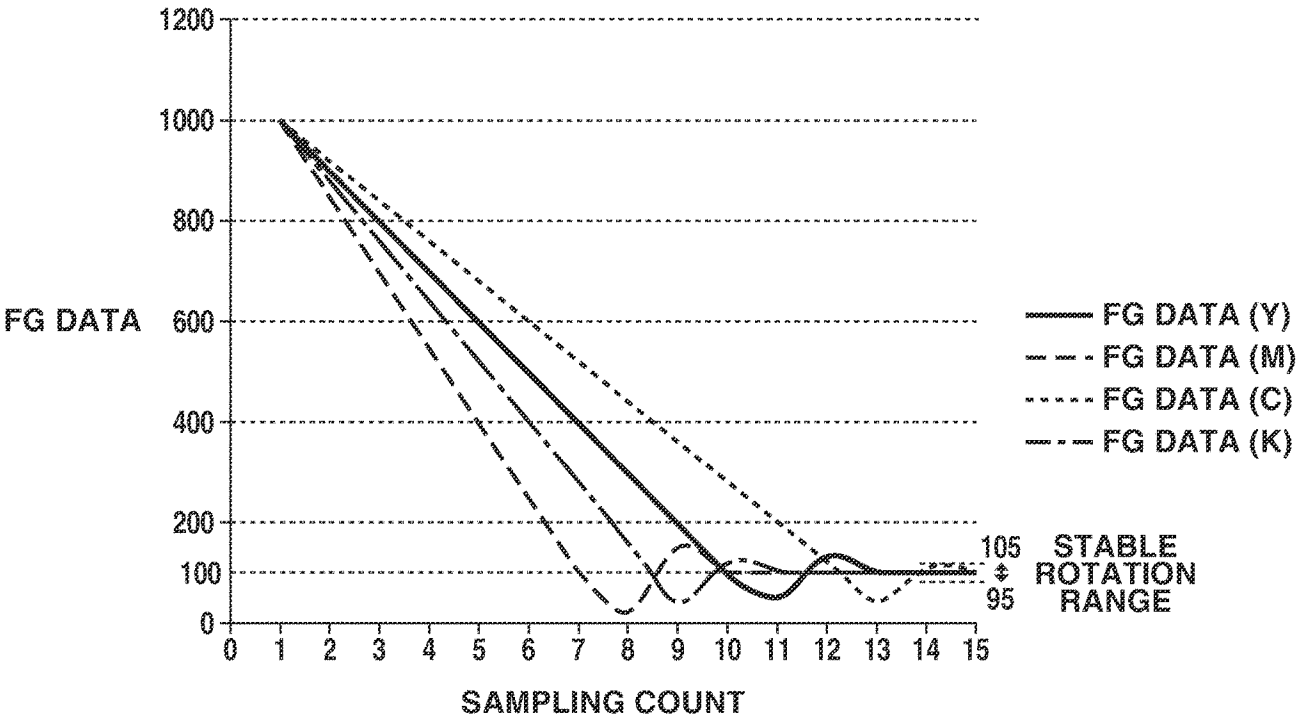
FIG. 5 is a diagram illustrating an example of FG data according to an exemplary embodiment.

Next, the FG data to be input from each of the ASICs 301 to 304 to the CPU 305 will be described. FIG. 5 illustrates a table (an upper diagram) indicating an example of the FG data output from each of the ASICs 301 to 304 in a transition period in which the scanner motor 203 of each of the optical scanning devices 101 to 104 of Y, M, C, and K transitions from the stop state to the stable rotation. FIG. 5 also illustrates a graph (a lower diagram) in which the FG data in the table is plotted. In the table in FIG. 5, the first row indicates a sampling count of the FG data. In the row, "1" represents the first sampling, and "15" represents the 15th sampling. Therefore, the data illustrated in FIG. 5 indicates a history of the FG data for 15 rotations of the scanner motor 203 in each of the optical scanning devices 101 to 104. Further, FG data (Y), FG data (M), FG data (C), and FG data (K) in the second, third, fourth, and fifth rows, respectively, indicate the FG data output from the ASICs 301 to 304 for controlling the optical scanning devices 101 to 104 of Y, M, C, and K. In the present exemplary embodiment, FG data=100 is a target rotation count. In a case where FG data is 105 (a second counter value)>FG data>95 (a first counter value), the scanner motor 203 is in the stable rotation state. The table in FIG. 5 indicates the FG data as follows. At the first sampling, all the FG data are 999 and the FG signal is not output. At the second sampling, all the FG data are data other than 999, the scanner motor 203 is rotating, and the FG signal is output. Further, at the 14th sampling, all the FG data are within a range of 95 to 105, and the scanner motor 203 is in the stable rotation state. At the 15th sampling, all the FG data are 100, and the scanner motor 203 of each of the optical scanning devices 101 to 104 is stably rotating at the target rotation count.

The graph in FIG. 5 is a graph in which the data in the table in FIG. 5 is plotted, and a vertical axis indicates the FG data, whereas a horizontal axis indicates the sampling count.

In FIG. 5, a solid line indicates the FG data (Y) output from the ASIC 301, a broken line indicates the FG data (M) output from the ASIC 302, and a dotted line indicates the FG data (C) output from the ASIC 303. Further, a dot-and-dash line indicates the FG data (K) output from the ASIC 304. The graph in FIG. 5 indicates such a state that the FG data being 999 at the first sampling converges on a stable rotation range (95<FG counter<105), as the sampling count increases. At the 14th and 15th samplings, the FG data falls within the stable rotation range.

[SFG]

As illustrated in FIG. 5, the sampling count from the startup of the scanner motor 203 to the stable rotation varies for each of the optical scanning devices. However, in FIG. 5, the scanner motor 203 of each of all the optical scanning devices 101 to 104 reaches the stable rotation at the sampling count=15. Here, the state where the FG signal is not input and the FG data is 999 at the sampling count=15 as described with reference to FIG. 4A is defined as StopFG-data (SFG).

Next, a method for counting the SFG will be described. FIG. 6 is a table obtained by counting cases where the scanner motor 203 is not driven and thus the SFG state is established in each of the optical scanning devices 101 to 104 at the sampling count=15. In FIG. 6, each of columns of SFG (Y), SFG (M), SFG (C), and SFG (K) includes 1 in a case where the FG data from each of the ASICs 301 to 304 for controlling the optical scanning devices 101 to 104 is 999, and 0 in a case where the FG data is a number other than 999. Further, a column of SFGtotal indicates the number of 1s in the SFG (Y), the SFG (M), the SFG (C), and the SFG (K). In other words, a case where the SFGtotal is 0 indicates that no optical scanning device is in the SFG state at the sampling count=15. A case where the SFGtotal is 1, a case where the SFGtotal is 2, and a case where the SFGtotal is 3, respectively, indicate that one optical scanning device, two optical scanning devices, and three optical scanning devices are in the SFG state at the sampling count=15. Further, a case where the SFGtotal is 4 indicates that all the four optical scanning devices 101 to 104 are in the SFG state at the sampling count=15. For example, there is only one combination in the case where the SFGtotal is 0 or 4. There are six combination patterns in the case where the SFGtotal is 2, and there are four combination patterns in the case where the SFGtotal is 3.

[Startup Control Sequence for Scanner Motor of Optical Scanning Device]

Figure 7:
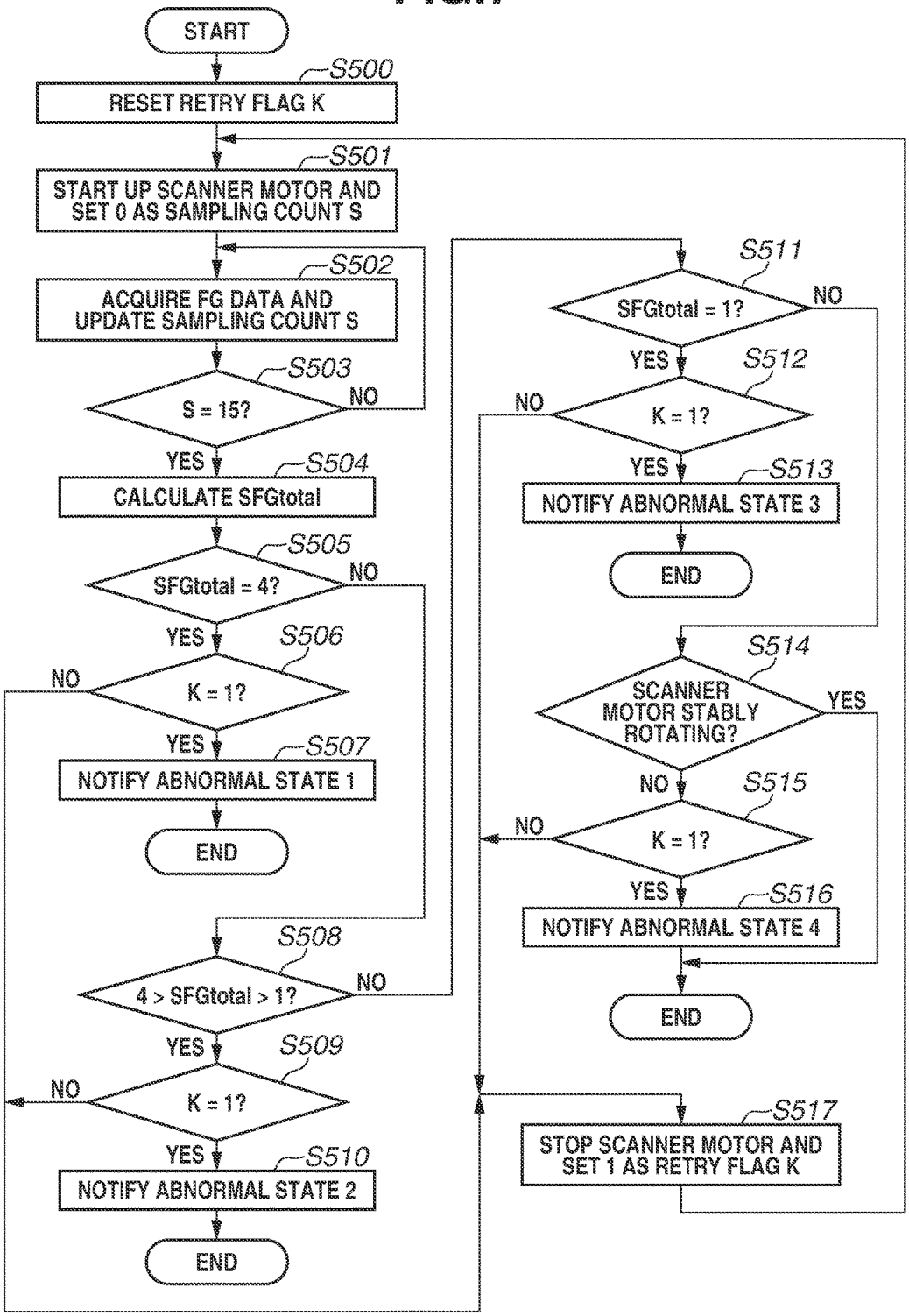
FIG. 7 is a flowchart illustrating an abnormality determination sequence of an optical scanning device according to an exemplary embodiment.

Next, a control sequence performed by the CPU 305 to detect an abnormal state of each of the optical scanning devices 101 to 104 according to the FG data will be described. FIG. 7 is a flowchart illustrating a control sequence for starting up the scanner motors 203 of the optical scanning devices 101 to 104. The controller 130 starts processing in FIG. 7 to activate the optical scanning devices 101 to 104 in the image formation, and the CPU 305 of the controller 300 executes the started processing. In the present exemplary embodiment, the optical scanning devices 101 to 104 of Y, M, C, and K are started up to form a color image.

In step S500, the CPU 305 resets a retry flag K indicating whether the current startup control of the scanner motor 203 is a first time (0) or a retry (1). In step S501, the CPU 305 transmits the control signals for ordering the startup control of the scanner motors 203 of the optical scanning devices 101 to 104 to the ASICs 301 to 304. Further, the CPU 305 sets 0 as a sampling count S indicating a sampling frequency of the FG data from each of the ASICs 301 to 304. The ASICs 301 to 304 having received the control signals from the CPU 305 output the reference clock signals to the respective optical scanning devices 101 to 104 and selection signals for instructing the PLL circuits 201 to output the FG signals, thereby starting the startup control of the scanner motors 203. In addition, the ASICs 301 to 304 each start the FG counter after the FG counter is reset, and thereby start counting by the FG counter to output the FG data to the CPU 305. In step S502, the CPU 305 acquires the FG data from each of the ASICs 301 to 304 and updates the sampling count S by adding 1. In step S503, the CPU 305 determines whether the sampling count S is 15. If the CPU 305 determines that the sampling count S is 15 (YES in step S503), the processing proceeds to step S504. If the CPU 305 determines that the sampling count S is not 15 (NO in step S503), the processing returns to step S502.

In step S504, the CPU 305 calculates the SFGtotal based on the FG data acquired from the ASICs 301 to 304 when the sampling count S is 15. In other words, the CPU 305 calculates how many FG data of 999 (the state where the scanner motor 203 is not rotating, and the FG signal is not output) are included in the FG data acquired when the sampling count S is 15. In step S505, the CPU 305 determines whether the value of the SFGtotal calculated in step S504 is 4, i.e., whether the scanner motor 203 is not normally started up in each of the optical scanning devices 101 to 104. If the CPU 305 determines that the value of the SFGtotal is 4 (YES in step S505), the processing proceeds to step S506. If the CPU 305 determines that the value of the SFGtotal is not 4 (NO in step S505), the processing proceeds to step S508. In step S506, based on the retry flag K, the CPU 305 determines whether the retry is already performed. If the CPU 305 determines that the retry flag K is 1, i.e., the retry is already performed (YES in step S506), the processing proceeds to step S507. If the CPU 305 determines that the retry flag K is not 1, i.e., the retry has not been performed (NO in step S506), the processing proceeds to step S517. In step S517, the CPU 305 transmits the control signals for ordering the startup-stop of the optical scanning devices 101 to 104 to the ASICs 301 to 304 to forcefully stop the driving of the scanner motors 203. Further, the CPU 305 sets 1 as the retry flag K and the processing returns to step S501. The ASICs 301 to 304 having received the control signals from the CPU 305 stop outputting the reference clock signals to the optical scanning devices 101 to 104, respectively, to stop the startup of the scanner motors 203, and each also stop the counting by the FG counter.

[Control for Case of Abnormal State 1]

In step S507, the CPU 305 notifies the controller 130 of an abnormal state 1 where the scanner motors 203 of all the optical scanning devices 101 to 104 are not started up. The CPU 305 then transmits the control signals for ordering the startup-stop of the scanner motors 203 of the optical scanning devices 101 to 104 to the ASICs 301 to 304, and the processing ends. To stop the startup of the scanner motors 203, the ASICs 301 to 304 having received the control signals from the CPU 305 stop outputting the reference clock signals to the optical scanning devices 101 to 104, respectively, and each also stop the counting by the FG counter.

Figure 8:
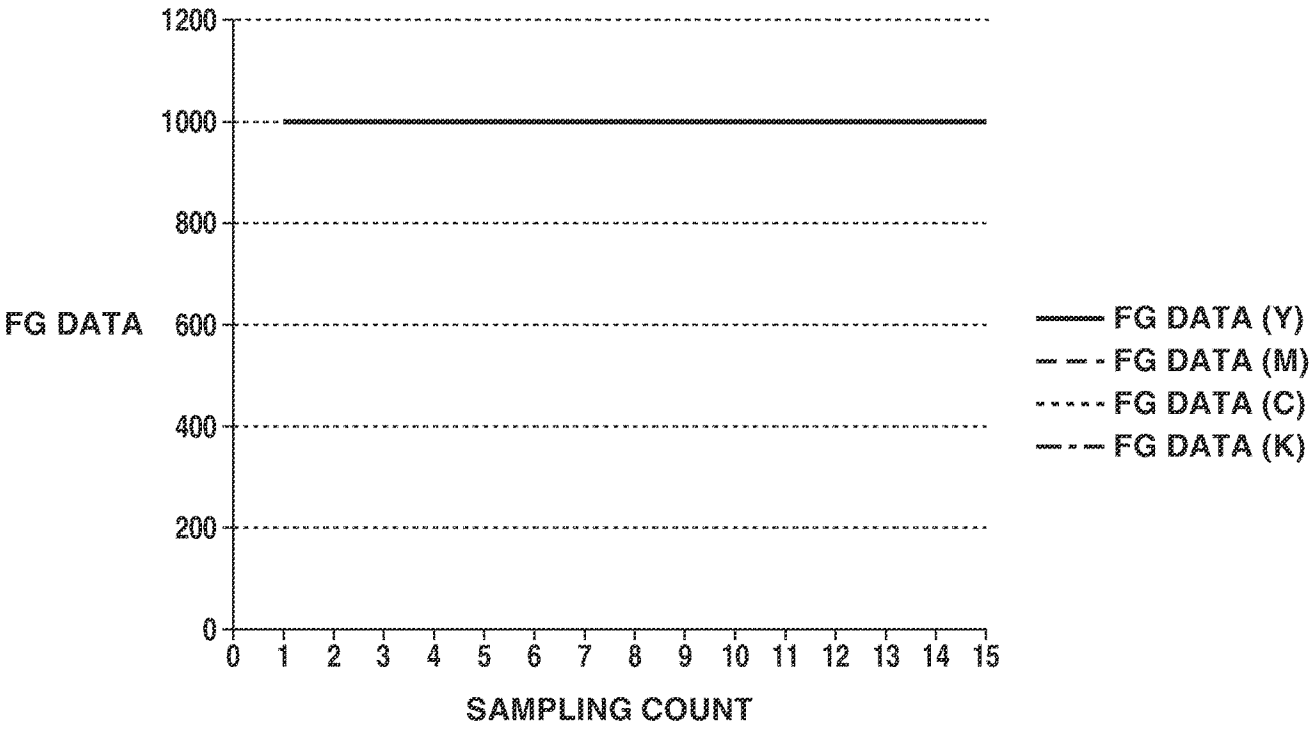
FIG. 8 is a diagram illustrating an abnormal state of FG data according to an exemplary embodiment.

FIG. 8 illustrates a table indicating an example of the FG data acquired by the CPU 305 from the ASICs 301 to 304 in the case of the abnormal state 1, and a graph in which the FG data in the table is plotted. How to view the table and the graph in FIG. 8 is similar to that described above for FIG. 5, and thus description thereof will be omitted here. The values of the FG data in the table are all 999 at the sampling counts 1 to 15, indicating that the scanner motor 203 of each of the optical scanning devices 101 to 104 has not been rotating since the start of the startup control, and the FG signal is not output. In this way, in a case where the FG data at the sampling count=15 acquired from all the ASICs 301 to 304 remain in the SFG state of 999 despite the startup of the scanner motors 203, occurrence of an abnormality is conceivable. The conceivable abnormality may be an abnormality of each of the optical scanning devices, or an abnormality caused by disconnection of each of signals via the connectors 306 to 309 linking the optical scanning devices 101 to 104 with the controller 300. However, conceivably, a possibility of occurrence of an abnormality in the 24-V DC power supply voltage supplied from the power supply device 150 to each of the optical scanning devices 101 to 104 via the controller 300 is higher than a possibility of occurrence of simultaneous abnormalities in the individual optical scanning devices 101 to 104. In other words, conceivably, the controller 300 has such an abnormality that the 24 V power supply voltage is not output from the power supply device 150, or the power supply path 311 on the control circuit board of the controller 300 is disconnected. The CPU 305, therefore, notifies the controller 130 of alarm information indicating the abnormal state 1 including a suggestion for making an abnormality check of the power supply device 150, or the control circuit board of the controller 300.

In step S508, the CPU 305 determines whether the value of the SFGtotal calculated in step S504 is less than 4 and more than 1, i.e., whether the scanner motor 203 of each of two or three optical scanning devices among the optical scanning devices 101 to 104 is not normally started up. If the CPU 305 determines that the value of the SFGtotal is less than 4 and more than 1 (YES in step S508), the processing proceeds to step S509. If the CPU 305 determines that the value of the SFGtotal is not less than 4 or not more than 1 (the SFGtotal is 0 or 1) (NO in step S508), the processing proceeds to step S511. In step S509, based on the retry flag K, the CPU 305 determines whether the retry is already performed. If the CPU 305 determines that the retry flag K is 1, i.e., the retry is already performed (YES in step S509), the processing proceeds to step S510. If the CPU 305 determines that the retry flag K is not 1, i.e., the retry has not been performed (NO in step S509), the processing proceeds to step S517.

[Control for Case of Abnormal State 2]

In step S510, the CPU 305 notifies the controller 130 of an abnormal state 2 where the scanner motor 203 of each of two or three optical scanning devices among the optical scanning devices 101 to 104 is not started up. The CPU 305 then transmits the control signals for ordering the startup-stop of the scanner motors 203 of the optical scanning devices 101 to 104 to the ASICs 301 to 304, and the processing ends. To stop the startup of the scanner motors 203, the ASICs 301 to 304 having received the control signals from the CPU 305 stop outputting the reference clock signals to the optical scanning devices 101 to 104, respectively, and each also stop the counting by the FG counter.

Figure 9:
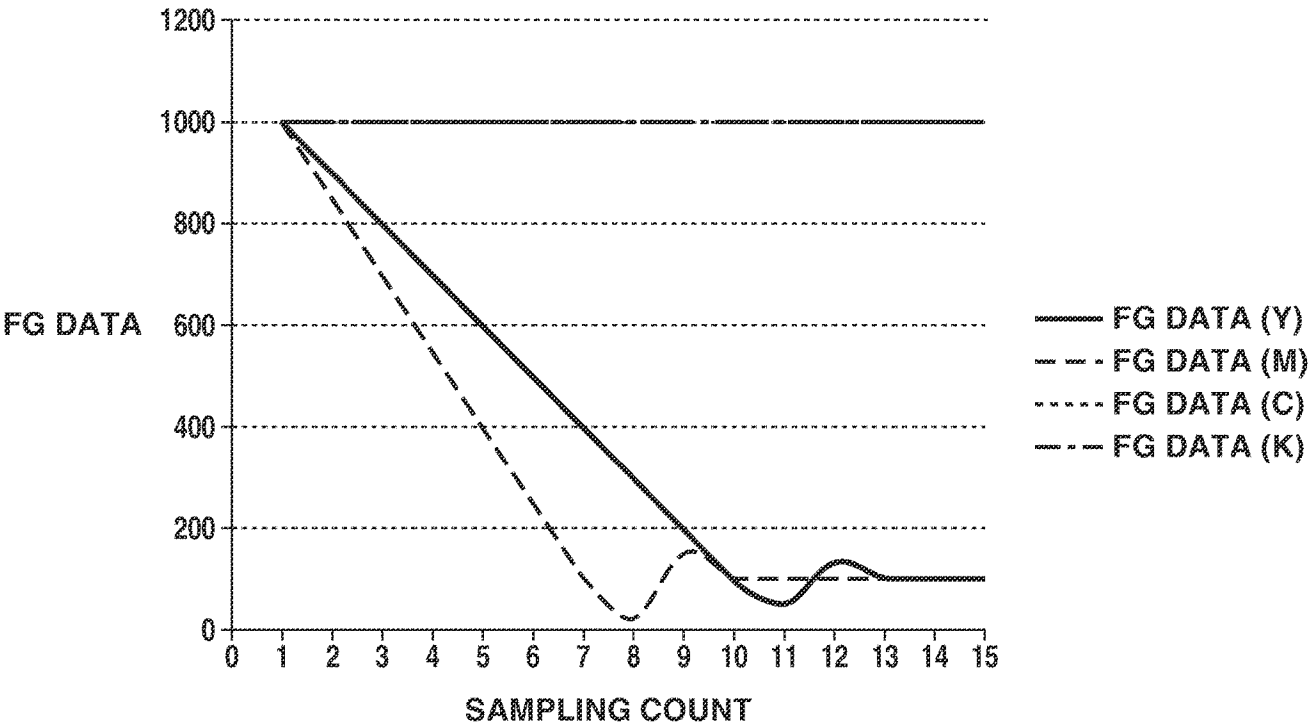
FIG. 9 is a diagram illustrating an abnormal state of FG data according to an exemplary embodiment.

FIG. 9 illustrates a table indicating an example of the FG data acquired by the CPU 305 from the ASICs 301 to 304 in the case of the abnormal state 2 where the SFGtotal is 2, and a graph in which the FG data in the table is plotted. How to view the table and the graph in FIG. 9 is similar to that described above for FIG. 5, and thus description thereof will be omitted here. As for the FG data (C) and the FG data (K) among the FG data in the table, the values of the FG data are all 999 at the sampling counts 1 to 15. This indicates that the scanner motor 203 of each of the optical scanning devices 103 and 104 has not been rotating since the start of the startup control, and the FG signal is not output. In this way, in a case where the FG data at the sampling count=15 acquired from all the ASICs 303 and 304 remain in the SFG state of 999 despite the startup of the scanner motors 203, occurrence of an abnormality is conceivable. The conceivable abnormality may be an abnormality of each of the optical scanning devices 103 and 104, or an abnormality caused by disconnection of each of signals via the connectors 308 and 309 linking the optical scanning devices 103 and 104 with the controller 300. However, conceivably, a possibility of occurrence of an abnormality of the controller 300 such as disconnection between the branch point 2 and the branch point 3 of the power supply path 311 on the control circuit board of the controller 300 is higher than a possibility of occurrence of simultaneous abnormalities in the two optical scanning devices 103 and 104. The CPU 305, therefore, notifies the controller 130 of alarm information indicating the abnormal state 2 including a suggestion for making an abnormality check of the control circuit board of the controller 300.

FIG. 9 illustrates an example of the abnormal state 2. As illustrated in FIG. 6, there are six combination patterns in the case where the SFGtotal is 2, and there are four combination patterns in the case where the SFGtotal is 3 (one of these patterns is the example illustrated in FIG. 9). In each of the combination patterns corresponding to the abnormal state 2, a conceivable abnormality may be an abnormality of the corresponding optical scanning device for which 1 is set as the SFG, or an abnormality caused by disconnection of the signal via the connector linking the controller 300 with the corresponding optical scanning device. Further, as an abnormal pattern relevant to the power supply path 311 for supplying the 24-V DC power supply voltage to the optical scanning device, there are a case where each of the SFG (M), the SFG (C), and the SFG (K) is 1, and a case where each of the SFG (Y), the SFG (C), and the SFG (K) is 1, in the case where the SFGtotal is 3. Only a combination pattern in which each of the SFG (C) and the SFG (K) is 1 as described with reference to FIG. 9 is an abnormal pattern relevant to an abnormality of the power supply path 311 for supplying the 24-V DC power supply voltage to the optical scanning device in the case where the SFGtotal is 2. In the case where each of the SFG (M), the SFG (C), and the SFG (K) is 1, there may be conceivably an abnormality of the controller 300 such as disconnection between the branch point 1 and the branch point 2 of the power supply path 311 on the control circuit board of the controller 300. In the case where each of the SFG (Y), the SFG (C), and the SFG (K) is 1, there may be conceivably an abnormality of the controller 300 such as disconnection between the branch point 2 and the branch point 3, without disconnection between the branch point 1 and the branch point 2 of the power supply path 311 on the control circuit board of the controller 300. In this way, in a case where the optical scanning device 104 connected to the most downstream side of the power supply path 311 is in the SFG state, or the optical scanning devices 103 and 104 adjacent to each other in the upstream direction of the power supply path 311 are in the SFG state, the power supply path 311 may be disconnected. Thus, in such a case, the CPU 305 notifies the controller 130 of alarm information indicating the abnormal state 2 including a suggestion for making an abnormality check of the control circuit board of the controller 300.

In step S511, the CPU 305 determines whether the value of the SFGtotal calculated in step S504 is 1, i.e., whether the scanner motor 203 of one optical scanning device among the optical scanning devices 101 to 104 is not normally started up. If the CPU 305 determines that the value of the SFGtotal is 1 (YES in step S511), the processing proceeds to step S512. If the CPU 305 determines that the value of the SFGtotal is not 1 (NO in step S511), i.e. the SFGtotal is 0, the processing proceeds to step S514. In step S512, the CPU 305 determines whether the retry is already performed. If the CPU 305 determines that the retry flag K is 1, i.e., the retry is already performed (YES in step S512), the processing proceeds to step S513. If the CPU 305 determines that the retry flag K is not 1, i.e., the retry has not been performed (NO in step S512), the processing proceeds to step S517.

[Control for Case of Abnormal State 3]

In step S513, the CPU 305 notifies the controller 130 of an abnormal state 3 where the scanner motor 203 of one optical scanning device among the optical scanning devices 101 to 104 is not started up. The CPU 305 then transmits the control signals for ordering the startup-stop of the scanner motors 203 of the optical scanning devices 101 to 104 to the ASICs 301 to 304, and the processing ends. To stop the startup of the scanner motors 203, the ASICs 301 to 304 having received the control signals from the CPU 305 stop outputting the reference clock signals to the optical scanning devices 101 to 104, respectively, and each also stop the counting by the FG counter.

Figure 10:
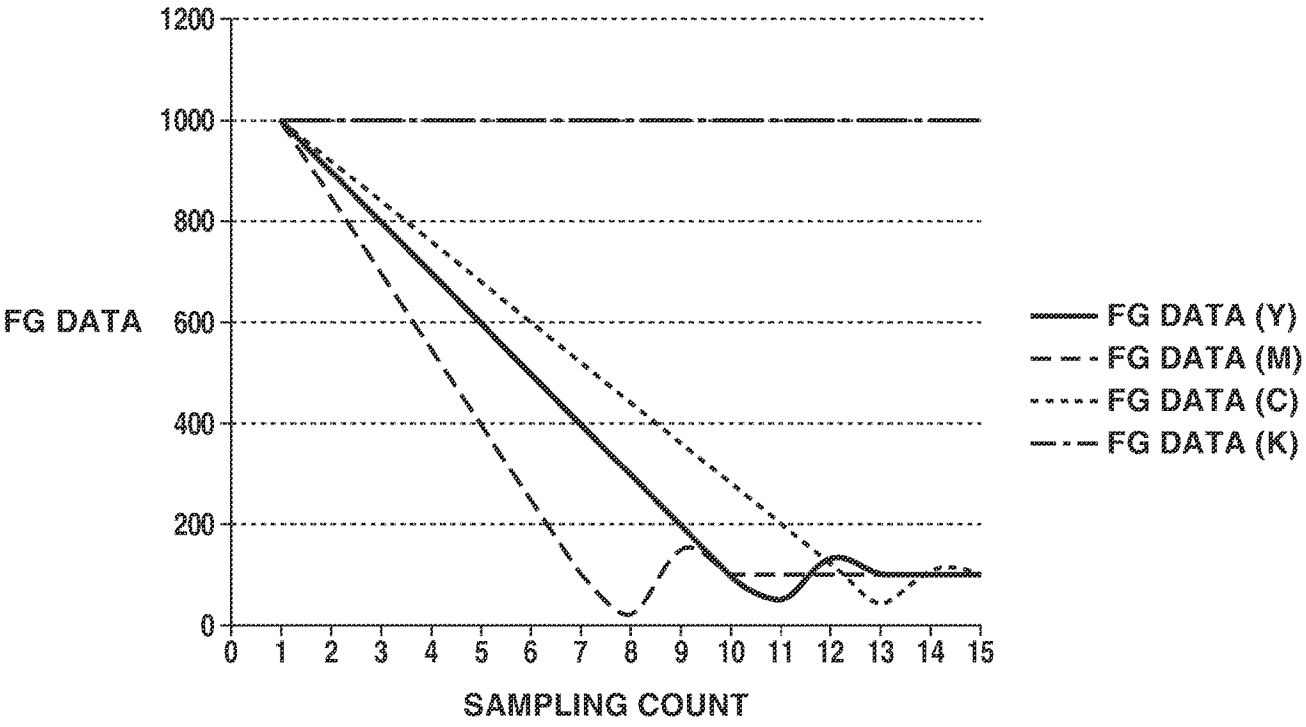
FIG. 10 is a diagram illustrating an abnormal state of FG data according to an exemplary embodiment.

FIG. 10 illustrates a table indicating an example of the FG data acquired by the CPU 305 from the ASICs 301 to 304 in the case of the abnormal state 3, and a graph in which the FG data in the table is plotted. How to view the table and the graph in FIG. 10 is similar to that described above for FIG. 5, and thus description thereof will be omitted here. As for the FG data (K) among the FG data in the table, the values of the FG data are all 999 at the sampling counts 1 to 15, indicating that the scanner motor 203 of the optical scanning device 104 has not been rotating since the start of the startup control, and the FG signal is not output. In this way, in a case where the FG data at the sampling count=15 acquired from the ASIC 304 remains in the SFG state of 999 despite the startup of the scanner motor 203, occurrence of an abnormality is conceivable. The conceivable abnormality may be an abnormality of the corresponding optical scanning device 104 for which 1 is set as the SFG, or an abnormality caused by disconnection of the signal via the connector 309 linking the controller 300 with the corresponding optical scanning device. Specifically, there is conceivably an abnormality in the reference clock signal output from the ASIC 304 to the optical scanning device 104, the power supply voltage of the 24-V DC, the connector 309 provided between the ASIC 304 and the optical scanning device 104, or the scanner motor 203 in the optical scanning device 104. Occurrence of a similar abnormality is conceivable, also in a case where the FG data (Y), the FG data (M), and the FG data (C) are in the SFG state. The CPU 305, therefore, notifies the controller 130 of alarm information indicating the abnormal state 3 including a suggestion for making an abnormality check of the controller 300 and the optical scanning device corresponding to the SFG state. In the case illustrated in FIG. 10, it is conceivable that there is also an abnormality of the controller 300 such as disconnection between the branch point 3 of the power supply path 311 on the control circuit board of the controller 300 and the connector 309.

In step S514, based on the FG data acquired from the ASICs 301 to 304 when the sampling count S is 15, the CPU 305 determines whether the stable rotation state where each of the FG data is larger than 95 and less than 105 is established, i.e., whether the scanner motor 203 is stably rotating. In a case where the CPU 305 determines that all the FG data acquired from the ASICs 301 to 304 are larger than 95 and less than 105 (YES in step S514), the CPU 305 determines that the scanner motor 203 of each of the optical scanning devices 101 to 104 is stably rotating, and the processing ends. On the other hand, in a case where the CPU 305 determines that the FG data not being larger than 95 and less than 105 is included in the FG data acquired from the ASICs 301 to 304, the CPU 305 determines that the scanner motor 203 not stably rotating is present (NO in step S514), and the processing proceeds to step S515. In step S515, the CPU 305 determines whether the retry is already performed. If the CPU 305 determines that the retry flag K is 1, i.e., the retry is already performed (YES in step S515), the processing proceeds to step S516. If the CPU 305 determines that the retry flag K is not 1, i.e., the retry has not been performed (NO in step S515), the processing proceeds to step S517.

[Control for Case of Abnormal State 4]

In step S516, the CPU 305 notifies the controller 130 of an abnormal state 4 where the optical scanning device having the scanner motor 203 not stably rotating is included in the optical scanning devices 101 to 104. The CPU 305 then transmits the control signals for ordering the startup-stop of the scanner motors 203 of the optical scanning devices 101 to 104 to the ASICs 301 to 304, and the processing ends. To stop the startup of the scanner motors 203, the ASICs 301 to 304 having received the control signals from the CPU 305 stop outputting the reference clock signals to the optical scanning devices 101 to 104, respectively, and each also stop the counting by the FG counter.

Figure 11:
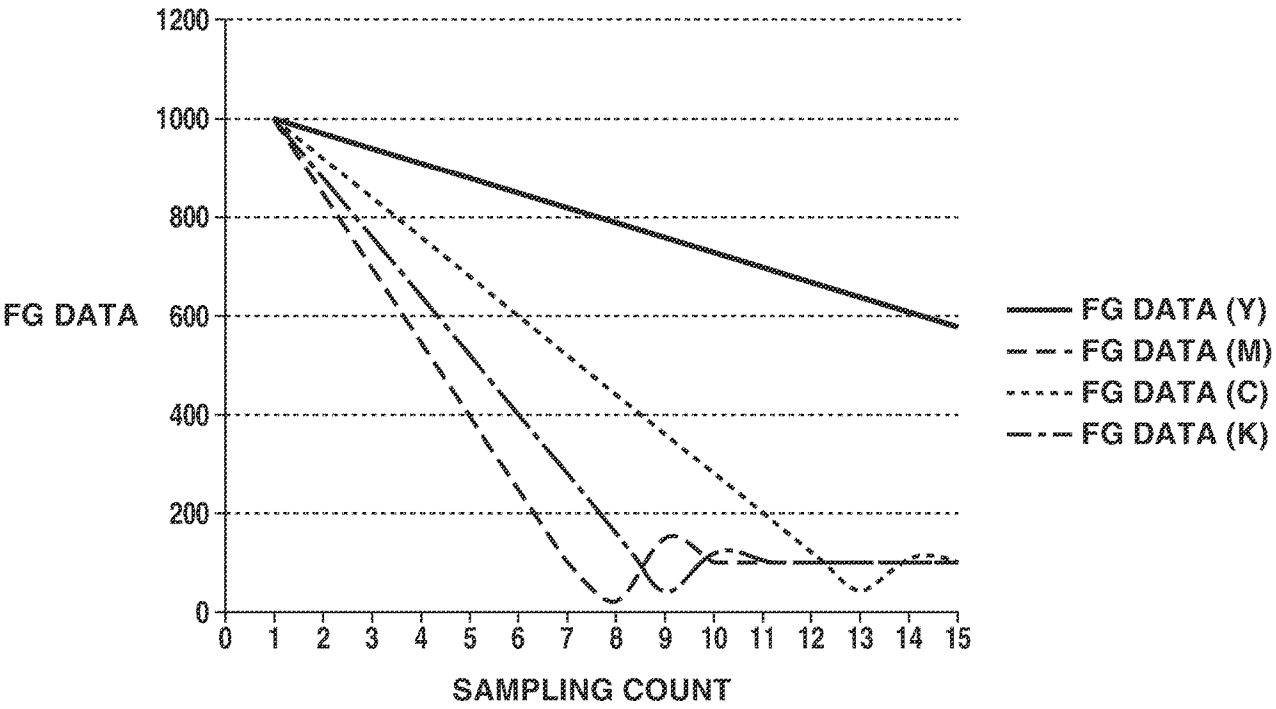
FIG. 11 is a diagram illustrating an abnormal state of FG data according to an exemplary embodiment.

FIG. 11 illustrates a table indicating an example of the FG data acquired by the CPU 305 from the ASICs 301 to 304 in the case of the abnormal state 4, and a graph in which the FG data in the table is plotted. How to view the table and the graph in FIG. 11 is similar to that described above for FIG. 5, and thus description thereof will be omitted here. As for the FG data (M), the FG data (C), and the FG data (K) among the FG data in the table, the values of the FG data are all 100 at the sampling count 15, indicating a target rotation state. On the other hand, as for the FG data (Y), the value of the FG data is 579 at the sampling count of 15, indicating that the scanner motor 203 of the optical scanning device 101 is not in the stable rotation state. In this way, in a case where the FG data at the sampling count=15 acquired from the ASIC 301 is not in the stable rotation state, occurrence of an abnormality is conceivable. Specifically, there is conceivably an abnormality of the scanner motor 203 in the optical scanning device 101, although there is no abnormality in the reference clock signal output from the ASIC 301 to the optical scanning device 101, the power supply voltage of the 24-V DC, and the connector 306, because the scanner motor 203 is rotating. Further, occurrence of a similar abnormality is conceivable, also in a case where any of the FG data (M), the FG data (C), and the FG data (K) indicates that the scanner motor is not in the stable state. The CPU 305, therefore, notifies the controller 130 of alarm information indicating the abnormal state 4 including a suggestion for making an abnormality check of the optical scanning device having the scanner motor 203 not stably rotating. The controller 130 notified of any of the above-described abnormal state 1 to 4 by the CPU 305 of the controller 300 stops the image forming operation, and displays alarm information including the information indicating the abnormality check notified by the CPU 305 at the display unit of the operation unit 140.

As described above, in a case where the scanner motor of the optical scanning device is not normally started up, the presence or absence of an abnormality of the power supply path for the optical scanning device is determined, based on the configuration of the power supply path for supplying power to each of the optical scanning devices, and the startup status of the scanner motor of each of the optical scanning devices. Thereby, in particular, in a case where a plurality of optical scanning devices is not normally started up, an abnormality factor can be accurately identified. In addition, in the present exemplary embodiment, whether the scanner motor is normally rotating is detected by resetting the counter based on the FG signal output from each of the optical scanning devices to detect the rotating state of the scanner motor of each of the optical scanning devices. Whether the optical scanning device is normally started up can be detected with such a simple configuration and thus, a cost reduction is achieved. As described above, according to the present exemplary embodiment, a fault at the time of occurrence of an abnormality in the optical scanning device can be accurately detected.

Other Exemplary Embodiment

The above-described exemplary embodiment is an exemplary embodiment applied to the optical scanning device having the 1-in-1 configuration in which one optical scanning device exposes one photosensitive drum. Among optical scanning devices, there is an optical scanning device having a 2-in-1 configuration in which one optical scanning device exposes two photosensitive drums. The above-described exemplary embodiment is applicable to the optical scanning device having the 2-in-1 configuration.

As for the optical scanning device having the 2-in-1 configuration, one optical scanning device can expose two photosensitive drums, i.e., can form an electrostatic latent image on each of the two photosensitive drums. FIG. 2 illustrates the configuration of the optical scanning device 101 having the 1-in-1 configuration. The case adopting the 2-in-1 configuration is similar to the configuration in FIG. 2, except that the two laser beams are emitted from the laser diode 206. Here, one optical scanning device is assumed to expose the photosensitive drum 14 corresponding to the yellow (Y) and the photosensitive drum 15 corresponding to the magenta (M). The other optical scanning device is assumed to expose the photosensitive drum 16 corresponding to the cyan (C) and the photosensitive drum 17 corresponding to the black (K). Thus, signals between the ASICs and the optical scanning devices are similar to those in FIG. 2, and in the case of using the optical scanning device having the 2-in-1 configuration, the number of ASICs in FIG. 3 is changed from four to two. Further, as for signals between the ASICs and the CPU 305 as well, control signals are output from the CPU 305 in a manner similar to those in FIG. 3, and the FG data (e.g., the FG data (Y, M) and the FG data (C, K)) are output from the ASICs. Accordingly, in the table in FIG. 6, in the case of adopting the 2-in-1 configuration, the SFGtotal is 0, 1, or 2, and the SFG (Y), the SFG (M), the SFG (C), and the SFG (K) are the SFG (Y, M) and the SFG (C, K). In a case where the SFGtotal is 0, there is one pattern that is a case where the SFG (Y, M) and the SFG (C, K) are both 0. In a case where the SFGtotal is 1, there are two patterns that are cases where either the SFG (Y, M) or the SFG (C, K) is 1. Further, in a case where the SFGtotal is 2, there is one pattern that is a case where the SFG (Y, M) and the SFG (C, K) are both 1. As for the flowchart in FIG. 7, the determination in step S505 is changed from "SFGtotal=4?" to "SFGtotal=2?". If the determination result is negative (NO in step S505), the processing proceeds to step S511 not to execute step S508 to step S510. The flowchart in FIG. 7 is thereby also applicable to the case of using the optical scanning device having the 2-in-1 configuration.

As for an abnormality of the power supply device 150 or the power supply path 311 on the control circuit board of the controller 300 in the case of adopting the 2-in-1 configuration, the following is conceivable. In other words, in a case where the SFGtotal is 2, conceivably, the controller 300 has such an abnormality that the 24 V power supply voltage is not output from the power supply device 150, or the power supply path 311 on the control circuit board of the controller 300 is disconnected, as in the case where the SFGtotal in the 1-in-1 configuration is 4. Further, in a case where the SFGtotal is 1, there may be conceivably an abnormality of the controller 300 such as disconnection between a branch point for the optical scanning device (Y, M) of the power supply path 311 on the control circuit board of the controller 300 and the connector of the optical scanning device (C, K).

As described above, according to the other exemplary embodiment, a fault at the time of occurrence of an abnormality in the optical scanning device can be accurately detected.

According to the exemplary embodiments of the present invention, a fault at the time of occurrence of an abnormality in the optical scanning device can be accurately detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-189561, filed Sep. 29, 2017, which is hereby incorporated by reference herein in its entirety.

What is claimed is:

1. An image forming apparatus comprising:

a plurality of image forming units having a photosensitive member at which an image is to be formed;

a plurality of optical scanning devices configured to expose the photosensitive member;

a controller configured to control the plurality of optical scanning devices; and a power supply device configured to supply power to the optical scanning device, wherein the optical scanning device includes a motor and an output unit, the motor rotating a rotatable polygon mirror for deflecting a light beam to allow scanning of a surface of the photosensitive member by the light beam emitted from a light source for emitting the light beam, and the output unit outputting a rotation signal by detecting a rotation of the motor, wherein the controller includes a startup controller, a control unit, and a power supply path, the startup controller being provided for the optical scanning device and performing startup control of the optical scanning device based on output of a drive signal for driving the motor, the control unit controlling the startup controller, and the power supply path being provided to supply the optical scanning device with power generated by the power supply device, wherein the startup controller includes a counter for counting a clock signal, the counter having a counter value to be reset by the rotation signal output from the output unit, and wherein, in a case where the motor is not normally driven when the optical scanning device is started up, the control unit notifies an abnormality of the power supply device or the power supply path, based on a counter value of the counter acquired from the startup controller.

2. The image forming apparatus according to claim 1, further comprising a connection unit configured to connect the controller and the optical scanning device, wherein power supply to the optical scanning device, transmission of the drive signal, reception of the rotation signal are performed via the connection unit.

3. The image forming apparatus according to claim 2, wherein the power supply path has a branch path branching from the power supply path, and connected to the connection unit, in order to supply power to each of the optical scanning devices.

4. The image forming apparatus according to claim 3, wherein the rotation signal is output each time the motor makes one rotation.

5. The image forming apparatus according to claim 4, wherein, when the counter value becomes a predetermined value, the counter stops counting of the clock signal, and the startup controller notifies the control unit of the predetermined value, and wherein, when the rotation signal output from the output unit of the corresponding optical scanning device is input, the counter starts counting of a clock signal upon resetting a counter value, and the startup controller notifies the control unit of a counter value when the rotation signal is input.

6. The image forming apparatus according to claim 5, wherein, in a case where a counter value of the counter acquired from each of all the startup controllers is the predetermined value, the control unit notifies an abnormality of the power supply device or an abnormality of the power supply path.

7. The image forming apparatus according to claim 5, wherein, in a case where an optical scanning device connected most upstream in the power supply path is included in the optical scanning devices each corresponding to the startup controller in which the counter value of the counter is the predetermined value, the control unit notifies an abnormality of the power supply path.

8. The image forming apparatus according to claim 7, wherein the control unit further notifies an abnormality of the optical scanning device corresponding to the startup controller in which the counter value is the predetermined value, or an abnormality of the connection unit connecting the optical scanning device and the controller.

9. The image forming apparatus according to claim 5, wherein, in a case where the motor is not stably rotating, the control unit notifies an abnormality of the optical scanning device having the motor.

10. The image forming apparatus according to claim 9, wherein the counter value to be notified to the control unit when the motor is stably rotating is larger than a first counter value, and smaller than a second counter value that is larger than the first counter value and smaller than the predetermined value.

11. The image forming apparatus according to claim 1, wherein the optical scanning device exposes one of the photosensitive members.

12. The image forming apparatus according to claim 1, wherein the optical scanning device exposes two of the photosensitive members.

13. An image forming apparatus comprising:

a plurality of photosensitive members;

a plurality of optical scanning devices, wherein each of the plurality of optical scanning devices corresponds to one of the plurality of photosensitive members, wherein each optical scanning device comprises:

a light source configured to emit a laser beam;

a rotatable polygon mirror configured to deflect the laser beam to scan the photosensitive member corresponding to the laser beam;

a drive motor configured to drive the rotatable polygon mirror;

a driver configured to drive the drive motor; and an output unit configured to output a rotation detection signal corresponding to a rotation period of the drive motor according to the rotation of the drive motor;

a power supply device configured to supply power to the plurality of optical scanning devices to drive a plurality of the motors; and a controller configured to control the plurality of optical scanning devices and to be input with the rotation detection signals output from the plurality of the output units, wherein the controller determines whether each of the plurality of the drive motors has an abnormality or not based on the plurality of the rotation detection signals input from the plurality of the output units with respect to a driving sequence of the plurality of drivers driving the plurality of drive motors by receiving a drive signal.

14. The image forming apparatus according to claim 13, wherein, in a case where the controller determines that all of the plurality of the drive motors have abnormality, the controller alarms that the power supply device has abnormality.

15. The image forming apparatus according to claim 14, wherein, in a case where the controller determines that a part of the plurality of motors have abnormality, the controller informs the optical scanning device including the abnormal drive motor from among the plurality of optical scanning devices.

16. The image forming apparatus according to claim 15, wherein, in a case where the rotation detection signal doesn't reach a predetermined period over a predetermined period of time, the controller alarms that the drive motor that outputs the rotation detection signal has abnormality.

17. The image forming apparatus according to claim 13, further comprising:

a power supply path configured to electrically connect the power supply device and the plurality of optical scanning devices, wherein the power supply path branches to a plural directions between the power supply device and the plurality of optical scanning devices, and each of the plurality of branched power supply paths is electrically connected to the plurality of optical scanning devices, and wherein, in a case where the controller determines that all of the plurality of the drive motors have abnormality, the controller alarms that the power supply device or the power supply paths have abnormality.

18. The image forming apparatus according to claim 17, wherein, in a case where the controller determines that a part of the plurality of motors have abnormality, the controller informs the optical scanning device including the abnormal drive motor from among the plurality of optical scanning devices.

19. The image forming apparatus according to claim 17, wherein, in a case where the rotation detection signal doesn't reach a predetermined period over a predetermined period of time, the controller alarms that the drive motor that outputs the rotation detection signal has abnormality.

20. The image forming apparatus according to claim 13, further comprising:

a power supply path configured to electrically connect the power supply device and the plurality of optical scanning devices; and a substrate which is partially arranged with the power supply path, wherein the power supply path branches to a plural directions on the substrate between the power supply device and the plurality of optical scanning devices, and each of the plurality of branched power supply paths is electrically connected to the plurality of optical scanning devices, and wherein, in a case where the controller determines that all of the plurality of the drive motors have abnormality, the controller alarms that the power supply device or the substrate have abnormality.

21. The image forming apparatus according to claim 20, wherein, in a case where the controller determines that a part of the plurality of motors have abnormality, the controller informs the optical scanning device including the abnormal drive motor from among the plurality of optical scanning devices.

22. The image forming apparatus according to claim 21, wherein, in a case where the rotation detection signal doesn't reach a predetermined period over a predetermined period of time, the controller alarms that the drive motor that outputs the rotation detection signal has abnormality.

23. The image forming apparatus according to claim 20, wherein the controller is implemented on the substrate.

* * * * *